US009761937B2

(12) United States Patent
Runyon et al.

(10) Patent No.: US 9,761,937 B2
(45) Date of Patent: Sep. 12, 2017

(54) FRAGMENTED APERTURE FOR THE KA/K/KU FREQUENCY BANDS

(71) Applicant: VIASAT, INC., Carlsbad, CA (US)

(72) Inventors: Donald L Runyon, Peachtree Corners, GA (US); John D Voss, Cumming, GA (US)

(73) Assignee: VIASAT, INC., Carlsbad, CA (US)

( * ) Notice: Subject to any disclaimer, the term of this patent is extended or adjusted under 35 U.S.C. 154(b) by 0 days.

(21) Appl. No.: 15/162,953

(22) Filed: May 24, 2016

(65) Prior Publication Data

US 2016/0276743 A1 Sep. 22, 2016

Related U.S. Application Data

(63) Continuation of application No. 12/957,657, filed on Dec. 1, 2010, now Pat. No. 9,379,438.

(Continued)

(51) Int. Cl.

| | |
|---|---|
| ***H01Q 3/26*** | (2006.01) |
| ***H01Q 1/52*** | (2006.01) |
| ***H01Q 21/24*** | (2006.01) |
| ***H01Q 3/28*** | (2006.01) |
| ***H01Q 3/30*** | (2006.01) |
| ***H01Q 21/30*** | (2006.01) |
| ***H01Q 21/06*** | (2006.01) |

(52) U.S. Cl.

CPC ..... *H01Q 1/523* (2013.01); *H01Q 3/26* (2013.01); *H01Q 3/2617* (2013.01); *H01Q 3/28* (2013.01); *H01Q 3/30* (2013.01); *H01Q 21/065* (2013.01); *H01Q 21/245* (2013.01); *H01Q 21/30* (2013.01)

(58) Field of Classification Search

CPC ..... H01Q 21/24; H01Q 3/26; H01Q 21/245
USPC ..... 343/795, 853, 893; 342/361
See application file for complete search history.

(56) References Cited

U.S. PATENT DOCUMENTS 4,367,474 A 1/1983 Schaubert et al.
4,857,777 A 8/1989 Altes (Continued)

OTHER PUBLICATIONS

Chen et al., "A Novel Wideband Antenna Array with Tightly Coupled Octagonal Ring Elements", Progress in Electromagnetics Research, 2012, vol. 124, pp. 55-70.

(Continued)

*Primary Examiner* — Peguy Jean Pierre

(57) ABSTRACT

A system, device, and method for a broad-band array antenna are presented. More particularly, the application relates to a broad-band fragmented aperture phased array antenna for the Ka, K, and/or Ku frequency bands. In various exemplary embodiments, the antenna system may support dynamic polarization degradation correction. In one exemplary embodiment a method and system for a broad-band fragmented aperture phased array antenna for the Ka, K, and/or Ku frequency band is presented. In one exemplary embodiment, the fragmented aperture design functions in one or more of the Ku-band, K-band, and/or Ka-band. In another exemplary embodiment, the antenna system may include full electronic polarization agility. In one exemplary embodiment, the antenna system may further comprise a printed circuit board radiating element. The printed circuit board radiating element may be configured to function as an antenna. In one exemplary embodiment, the antenna system may support operation over multiple frequency bands.

12 Claims, 14 Drawing Sheets

Related U.S. Application Data

(60) Provisional application No. 61/265,587, filed on Dec. 1, 2009, provisional application No. 61/265,596, filed on Dec. 1, 2009.

(56) References Cited

U.S. PATENT DOCUMENTS

| | | | |
|---|---|---|---|
| 5,977,923 | A | 11/1999 | Contu et al. |
| 6,703,974 | B2 | 3/2004 | White et al. |
| 8,160,530 | B2 | 4/2012 | Corman et al. |
| 8,264,410 | B1 | 9/2012 | Wang |
| 9,379,438 | B1 | 6/2016 | Runyon et al. |

OTHER PUBLICATIONS

Herscovici et al., "A Fragmented Aperture-Coupled Microstrip Antenna", IEEE, 2008, 4 pgs.

Herscovici et al., "Scanning Characteristics of Aperture Coupled Fed Fragmented Microstrip Arrays", IEEE Antennas and Propagation Society International Symposium, 2009, 4 pgs.

Wang, "Broadband Planar Traveling-Wave Arrays (TWA) with 2-D Elements", IEEE, 2010, pp. 586-592.

Scan directions used to evaluate the antenna elements.

FRAGMENTED APERTURE FOR THE KA/K/KU FREQUENCY BANDS

CROSS-REFERENCE TO RELATED APPLICATION

This application is a continuation application of U.S. application Ser. No. 12/957,657, entitled "FRAGMENTED APERTURE FOR THE KA/K/KU FREQUENCY BANDS," which was filed on Dec. 1, 2010, which is a non-provisional application of U.S. Provisional Application No. 61/265,587, entitled "FRAGMENTED APERTURE FOR THE KA/K/KU FREQUENCY BANDS," which was filed on Dec. 1, 2009, and this application is also a non-provisional application of U.S. Provisional Application No. 61/265,596, entitled "ANTENNA TILE DEVICE AND DESIGN," which was filed on Dec. 1, 2009, all of which are hereby incorporated by reference.

FIELD OF INVENTION

The application relates to systems, devices, and methods for a broad-band array antenna. More particularly, the application relates to a broad-band fragmented aperture phased array antenna for the Ka, K, and/or Ku frequency bands.

BACKGROUND OF THE INVENTION

Radio spectrum refers to the part of the electromagnetic spectrum corresponding to radio frequencies, such as frequencies lower than around 300 GHz (or, equivalently, wavelengths longer than about 1 mm). Different parts of the radio spectrum are used for different radio transmission technologies and applications. Ranges of allocated frequencies are often referred to by their provisioned use (for example, cellular spectrum or television spectrum). Commercial satellite communications systems generally utilize the Ku-band and/or the Ka-band. Military satellite communication systems generally utilize a subset band of operation in the K-band and Ka-band. However, military and commercial applications increasingly need reliable broad-band array antennas solutions. For example, some military vehicles currently have need for multiple separate antennas with limited surface area and available payload supporting operational needs for line-of-sight (LOS) and beyond-line-of-sight (BLOS) communications. In addition, some military vehicles have need of antenna systems that have low radar cross-section (RCS).

SUMMARY OF THE INVENTION

In accordance with various aspects of the present invention, a system, device and method of communication including a fragmented aperture antenna design is depicted. In one exemplary embodiment, a method and system for a broad-band fragmented aperture phased array antenna for the Ka, K, and/or Ku frequency band is presented. In one exemplary embodiment, the fragmented aperture design functions in one or more of the Ku-band, K-band, and/or Ka-band. In another exemplary embodiment, the antenna system may include full electronic polarization agility. In one exemplary embodiment, the antenna system may facilitate mobile satellite communications by terminals in locations between 60° north and 60° south of the equator. In an exemplary embodiment, the antenna system architecture supports full-duplex operation. In another exemplary embodiment, the antenna system architecture supports half-duplex operation. In addition, in an exemplary embodiment the antenna system provides a single beam and in another exemplary embodiment the antenna provides multiple simultaneous beams.

In one exemplary embodiment, the antenna system further comprises a printed circuit board tile containing a plurality of radiating elements in a layered structure; the layered structure comprising a driven layer. In another exemplary embodiment, the layered structure comprises a driven layer and at least one parasitic layer. In an exemplary embodiment, the printed circuit board tile and radiating element are configured to function as an antenna. In yet another exemplary embodiment, the antenna system may support operation over substantially simultaneous multiple frequency bands. One benefit of an exemplary printed circuit board-implemented fragmented aperture is the dynamic polarization degradation correction.

BRIEF DESCRIPTION OF THE DRAWING FIGURES

A more complete understanding of the present invention may be derived by referring to the detailed description and draft statements when considered in connection with the appendix materials and drawing figures, wherein like reference numbers refer to similar elements throughout the drawing figures, and:

DETAILED DESCRIPTION

Figure 1A:
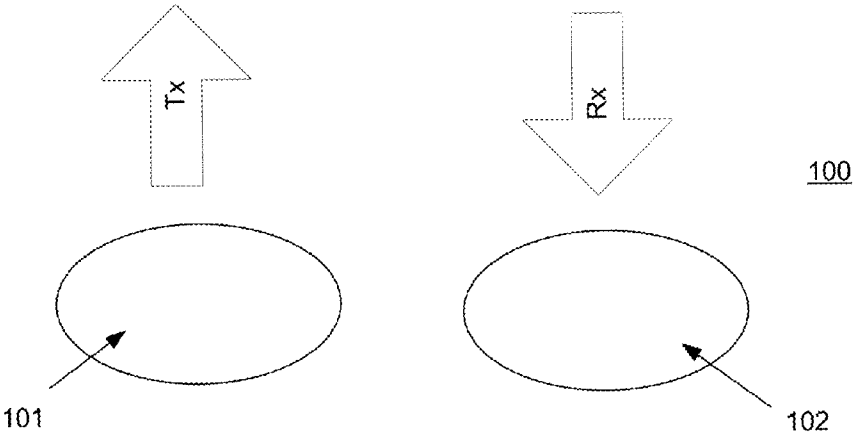
FIGS. 1A and 1B illustrates an exemplary dual-aperture antenna and a single aperture antenna, respectively, according to various embodiments of the disclosure.

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

In the late 1990's, fragmented antennas were developed in response to a need for aperture efficient, low frequency communication antennas. Recently, fragmented structure antennas have found application in wideband array architectures. For example, an 8×8 array of fragmented aperture elements has been found to achieve effective performance in excess of 10:1 frequency bandwidth. The fragmented design methodology takes advantage of the neighboring array elements and additionally exploits a large number of possible conductor patterns within conducting layers to achieve these wide bandwidths. In other words, the conductor patterns may be defined as an ensemble of conducting pixels of a particular size and the arrangement of pixels can result in wide bandwidth and wide angle scan characteristics when operatively coupled to neighboring array elements.

In accordance with an exemplary embodiment, a broadband fragmented aperture antenna for a high frequency band, such as the Ka, K and/or Ku frequency bands, is presented. In an exemplary embodiment, a fragmented aperture antenna is a computer-designed planar system of a phased array antenna with wide bandwidth ratios. The fragmented aperture antenna uses a patchwork of discrete conducting units and dielectric units distributed over the specified aperture. In an exemplary embodiment, the conducting units and dielectric units are electrically connected to result in, and take advantage of, mutual coupling. The mutual coupling enables the wide bandwidth ratios of the antenna. Furthermore, in an exemplary embodiment, the connections between the conducting units and dielectric units are reconfigured by opening and closing switches, which alters the conducting path. The reconfiguration changes the function of the aperture, including bandwidth and steering angle. In an exemplary embodiment, the connections between the conducting units are operatively coupled through active electronics that can alter and control the relative amplitude and phase of RF signals at either two terminals or four terminals of an element in an array.

In accordance with an exemplary embodiment, a fragmented aperture antenna is designed with a distribution of conducting regions on the aperture surface, which together with a suitably chosen permittivity greater than 2.0 and thickness of the dielectric substrate will produce a well-matched antenna over a large frequency range for all scan directions. Moreover, in an exemplary embodiment, a fragmented aperture antenna is manufactured using multiple layers of printed circuit boards. Furthermore, in an exemplary embodiment, the fragmented aperture antenna comprises a conducting pattern etched on a dielectric substrate backed by a groundplane. The conducting pattern, dielectric thickness and permittivity are designed with the help of a genetic algorithm (GA) or other suitable optimization algorithm or selection process. For more information on fragmented apertures, see, for example, U.S. Pat. No. 6,323,809, entitled "Fragmented Aperture Antennas and Broadband Antenna Ground Planes," and issued Nov. 27, 2001, which is hereby incorporated by reference.

In accordance with an exemplary embodiment and with reference to FIG. 1A, a fragmented dual-aperture antenna 100 comprises a first aperture 101 configured for transmission and a second aperture 102 configured for reception. In one embodiment, dual-aperture antenna 100 operates in full-duplex. Additionally, in an exemplary embodiment, fragmented dual-aperture antenna 100 operates in Ka-band and Ku-band frequencies. For example, first aperture 101 transmits at least a Ka-band signal and/or a Ku-band signal. Likewise, second aperture 102 receives at least a Ka-band signal and/or a Ku-band signal.

One example of a fragmented dual-aperture antenna is a direct broadcast system (DBS), which includes a beam that is dedicated to DBS at Ku-band or K-band. The DBS is a TV system with a dedicated receive aperture for receiving continuously streamed 1-way communications. In addition to the DBS beam, a fragmented dual aperture antenna may support 2-way full-duplex communications in Ka-band and/or Ku-band. In one variation of DBS, the 2-way communications may be configured to switch between frequency bands.

Figure 1B:
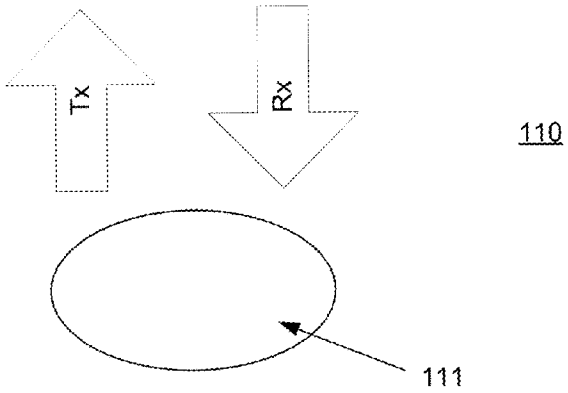

Additionally, in an exemplary embodiment and with reference to FIG. 1B, a fragmented aperture antenna 110 comprises a single aperture 111 configured for both transmit and receive utilizing half-duplex methods. In other words, the transmit and receive modes of fragmented aperture antenna 110 occur at different instances in time. The half-duplex operation of fragmented aperture antenna 110 includes transmitting and receiving signals using common radiating elements in single aperture 111. The amount of time devoted to transmitting or receiving is dependent on antenna application. In other words, if more data is being received than transmitted, then fragmented aperture antenna 110 is in a receive mode for a longer period of time than a transmit mode. Similar to fragmented dual-aperture antenna 100, in an exemplary embodiment, fragmented aperture antenna 110 operates in Ka-band and Ku-band frequencies. For example, single aperture 111 transmits at least a Ka-band signal and/or a Ku-band signal.

In one exemplary embodiment, the Ku-band of frequencies operates on a linear polarization. In another exemplary embodiment, the DBS band of frequencies operates on a circular polarization. In yet another exemplary embodiment, the DBS band of frequencies operates on a linear polarization. In another exemplary embodiment, the K-band and Ka-band of frequencies operates on a circular polarization. In one exemplary embodiment, a fragmented aperture is any suitable size to achieve the desired functional results, such as bandwidth and/or steering angle. In general, the smallest size fragmented aperture to achieve the desired functional results is preferable. Furthermore, the system operation and/or connection pattern of the coupled integrated antenna tiles may alter the radiating structure of the resulting fragmented aperture.

In an exemplary embodiment, a fragmented aperture phased array antenna generates a single beam that can be operated for transmission or receive in half-duplex mode. In another embodiment, the fragmented aperture phased array antenna generates a second beam. In one embodiment, the fragmented aperture phased array antenna generates dual-beams that can be simultaneously operated for transmitting or receiving in half-duplex mode. In another exemplary embodiment, the fragmented aperture phased array antenna system architecture may support multiple simultaneous beams. Additionally, in an exemplary embodiment, multiple phased array antennas could be present.

Figure 2:
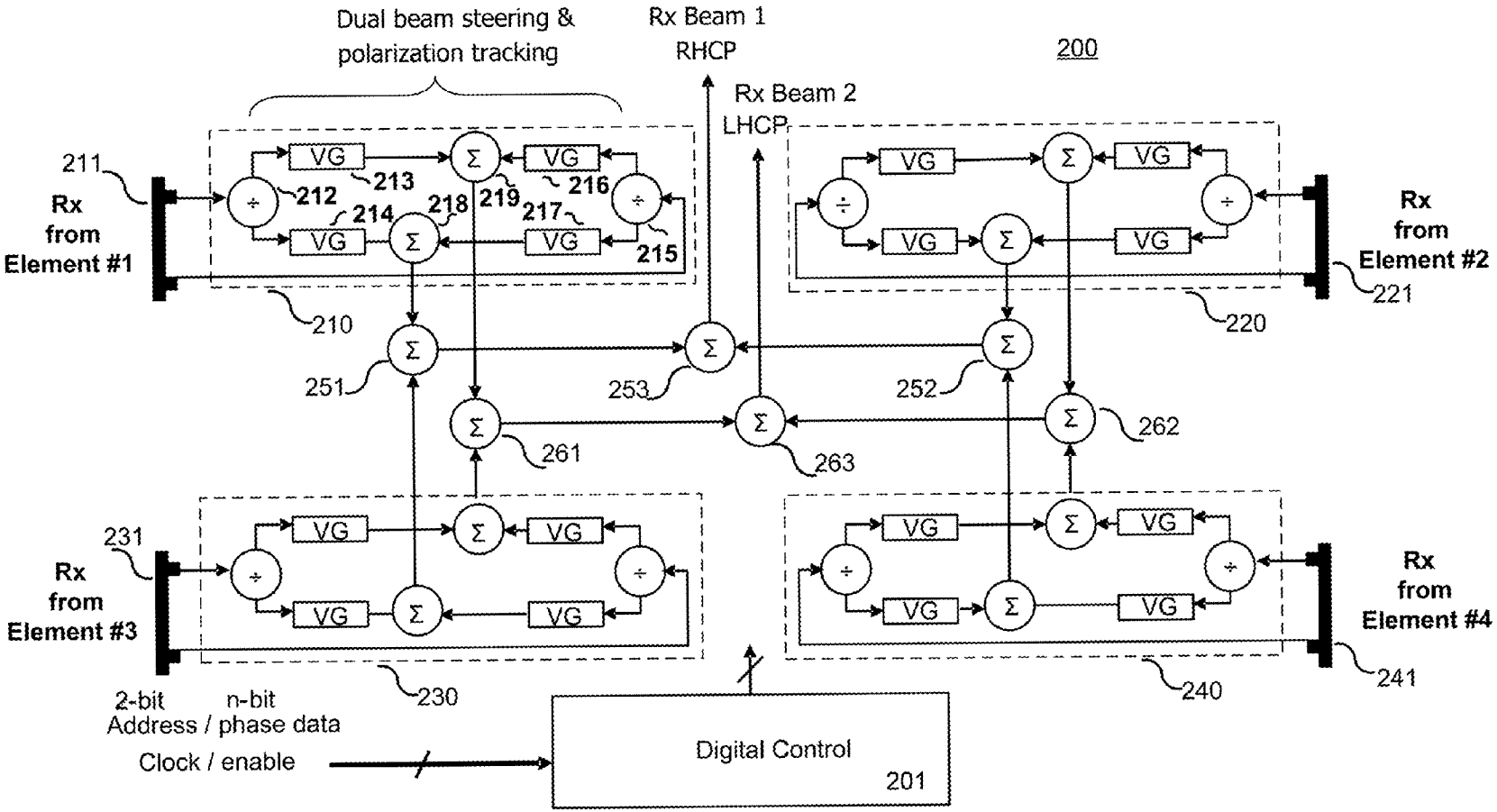
FIG. 2 illustrates an exemplary embodiment of a 2-beam, 4-radiating element receive array.

In order to operate using two frequency bands with different polarization, an exemplary phased array antenna implements independent polarization control. In an exemplary embodiment, the fragmented aperture phased array antenna system has full electronic polarization agility. In an exemplary embodiment and with reference to FIG. 2, a phased array integrated circuit 200 is configured as a 2-beam, 4-radiating element receiver with independent polarization. The phased array IC 200 comprises a first subcircuit 210 in communication with a first radiating element 211, a second subcircuit 220 in communication with a second radiating element 221, a third subcircuit 230 in communication with a third radiating element 231, and a fourth subcircuit 240 in communication with a fourth radiating element 241. Each subcircuit 210, 220, 230, 240 receives a pair of spatially orthogonal RF signals from the respectively coupled radiating element 211, 221, 231, 241 and generates two output signals, one for each beam to be formed.

The structure and function of each subcircuit 210, 220, 230, 240 is substantially similar. Thus, only first subcircuit 210 will be discussed in detail. In accordance with an exemplary embodiment, first subcircuit 210 controls dual-beam steering and polarization tracking. The exemplary first subcircuit 210 comprises a first active splitter 212 and a second active splitter 215. The two active splitters are configured to receive the RF input signals from radiating element 211, divide the respective signals, and transmit the divided signals to various vector generators. Specifically, active splitter 212 transmits a divided signal to a first vector generator 213 and a second vector generator 214. Similarly, active splitter 215 transmits a divided signal to a third vector generator 216 and a fourth vector generator 217. In an exemplary embodiment, vector generators 213, 214, 216, 217 control the polarization and beam steering of each signal communicated through. Furthermore, in an exemplary embodiment, first subcircuit 210 also comprises a first active combiner 218 and a second active combiner 219. First active combiner 218 combines two vector generator output signals from second vector generator 214 and fourth vector generator 217, respectively and generates a composite first beam component. Second active combiner 219 combines two vector generator output signals from first vector generator 213 and third vector generator 216, respectively and generates a composite second beam component. In an exemplary embodiment, a digital control 201 communicates polarization and beam steering commands to vector generators 213, 214, 216, 217.

In accordance with an exemplary embodiment, a first receive beam output is generated by combining one of the two output signals from each of four subcircuits 210, 220, 230, 240. A second receive beam output is generated by combining the second of the two output signals from each of four subcircuits 210, 220, 230, 240. In an exemplary embodiment, multiple combiners are used to combine the subcircuit output signals into a first receive beam output and a second receive beam output.

In a more specific exemplary embodiment, an active combiner 251 is configured to combine the first of the two outputs from first and third subcircuits 210, 230. Furthermore, an active combiner 261 is configured to combine the second of the two outputs from first and third subcircuits 210, 230. Also in the exemplary embodiment, an active combiner 252 is configured to combine the first of the two outputs from second and fourth subcircuits 220, 240. An active combiner 262 is configured to combine the second of the two outputs from second and fourth subcircuits 220, 240. At the next stage, an active combiner 253 is configured to combine the combined outputs of active combiners 251 and 252 to form a first receive beam output. Furthermore, an active combiner 263 is configured to combine the combined outputs of active combiners 261 and 262 to form a second receive beam output. Similar to the 2-beam, 4-radiating element receiver described above, in an exemplary embodiment, a phased array integrated circuit can be configured as a 2-beam, 4-radiating element transmitter with independent polarization. Because the implementation of such a transmitter would be understood by one skilled in the art in light of the above discussion, this discussion will not be repeated for the transmitter embodiment.

A fragmented aperture can be designed to operate in various frequency ranges. For example, the fragmented aperture phased array antenna may be configured to be operated in frequency bandwidths between about 10.7 GHz and about 31 GHz. For instance, the fragmented aperture phased array antenna may be configured to be operated at about 10.7-12.75 GHz receive, about 14.0-14.5 GHz transmit, about 17.7-21.2 GHz receive, and about 27.5-31.0 GHz transmit bands. In other words, the fragmented aperture phased array antenna system may be capable of receiving substantially simultaneously at about 10.7-12.75 GHz and about 17.5-21.2 GHz bands or transmitting substantially simultaneously at about 14.0-14.5 GHz and about 27.5-31.0 GHz. These signals may be at different polarizations or these signals may be configured to be the same polarization. Though the fragmented aperture phased array antenna may be designed for any suitable instantaneous bandwidth, in one exemplary embodiment, the instantaneous bandwidth is 500 MHz. In one exemplary embodiment, the transmit bands instantaneous bandwidth is 125 MHz.

Figure 3:
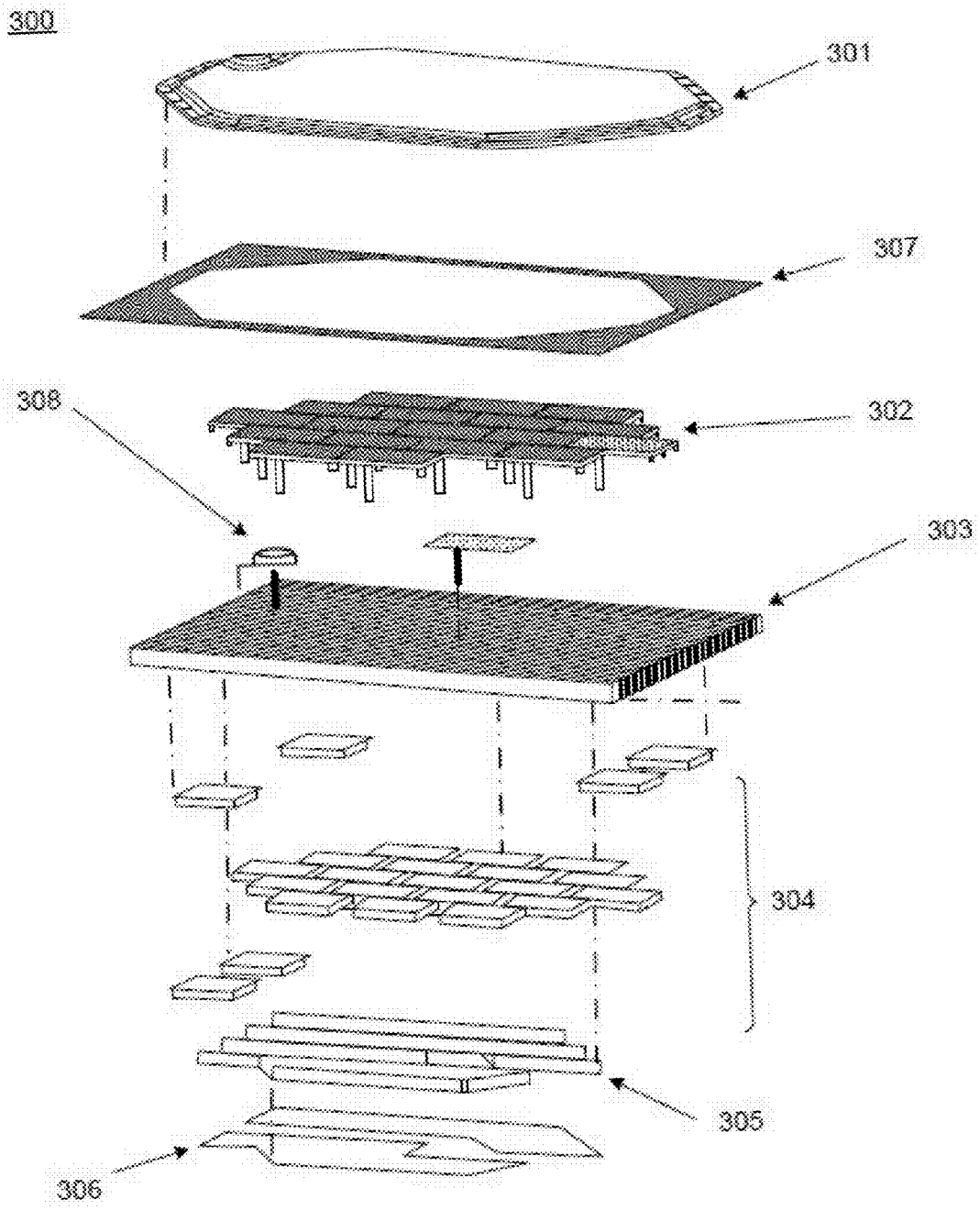
FIG. 3 illustrates an exploded view of a phased array antenna comprising a cold plate.

Furthermore, with reference to FIG. 3, other types of antennas may be present, such as a GPS antenna 308. GPS antenna 308 generally operates in a frequency range between about 1.2-1.6 GHz such as about 1.57542 GHz (L1 signal) and about 1.2276 GHz (L2 signal). A fragmented aperture phased array antenna 300 may comprise a system or a portion of a system configured to be mounted on a moving platform such as on a vehicle. The vehicle may be a military vehicle such a boat, helicopter, plane or tank, and/or the vehicle may be a commercial vehicle such as a car, plane, SUV, or truck. The fragmented aperture phased array antenna 300 may comprise a portion of a system or a system configured to be transported by a person or a machine.

In one exemplary embodiment, though the fragmented aperture phased array antenna may be designed for any suitable scan angle, the fragmented aperture phased array antenna coverage shall be capable of electronically scanning its beam in a 70° half-angle cone as measured from the antenna boresight. In another exemplary embodiment, fragmented aperture phased array antenna system may facilitate satellite communications for antenna terminals in locations between 60° north and 60° south of the equator. Additionally, in an exemplary embodiment, the main lobe of the beam is designed to be normal to the plane of the base plate to within about 0.25° when the beam is steered to the boresight position. In one exemplary embodiment, though the fragmented aperture phased array antenna may be designed for any suitable input impedance, the nominal input impedance of the fragmented aperture phased array antenna is about 50 Ohms. Furthermore, though a fragmented aperture phased array antenna may be designed for any suitable standing wave ratio, an exemplary fragmented aperture phased array antenna comprises a standing wave ratio of about 2:1 or less over a desired angular coverage and bandwidth. The realized gain may be greater than 55% efficient aperture over a desired angular coverage excluding reference scan loss. The reference scan loss power factor is $P(\theta)=\cos^{1.29}(\theta)$ that corresponds to approximately −6 dB of scan loss at 70° scan from boresight. This may include all losses in the aperture (including but not limited to active impedance mismatch, via loss, dielectric losses, and/or conductor losses). However, the reference scan loss may not include quantization loss. In an exemplary embodiment, quantization loss is dependent on the number of digital bits used in the antenna control. The realized gain may be relative to a perfectly circularly polarized isotropic radiating source of the appropriate sense for Ka-band and may be relative to a perfect linearly polarized isotropic radiating source of the appropriate tilt angle for Ku-band.

In one exemplary embodiment, the polarization of fragmented aperture phased array antenna 300 system shall be determined by substantially simultaneous orthogonal dual-linear polarization components. The polarization components correspond to the electromagnetic radiation properties of the dual basis polarizations of the array antenna. The basis polarizations of the array antenna may be a linear polarization that is defined relative to the array grid or a lattice for the boresight scan condition. The array grid or lattice is defined by spaced apart groups of feeds. Each radiating element structure in the antenna array is comprised of two pairs of feeds and each pair of feeds corresponds to a basis polarization. The degree of orthogonality (DO) may be defined by 20 $LOG_{10}$ of the dot product of the radiated polarizations corresponding to orthogonal basis polarizations. In one embodiment, a design objective of the fragmented aperture is the degree of orthogonality (DO) is set to meet a threshold value throughout the scan volume irrespective if the cross-polarization is degraded by polarization rotation effects resulting from a scan condition.

The orthogonality condition, DO, may be less than −15 dB within a desired coverage area or scan volume and over a 1 dB beamwidth. With this applied design criteria for the fragmented aperture, in an exemplary embodiment the amplitude control of the vector generator VG may be applied individually at each element to improve the aggregate or net polarization performance of the array for any scan condition or state. In an exemplary embodiment, though a fragmented aperture phased array antenna may be designed for any suitable amplitude difference between polarization components, the transmission phase difference between ports corresponding to orthogonal polarizations may not change more than 5° across the instantaneous bandwidth within the specified coverage area or scan volume. The transmission phase difference between ports corresponding to orthogonal polarizations may be less than 45° within a desired coverage area. In one exemplary embodiment, the objective scan loss may be −6 dB at maximum scan, where the maximum scan is 70°, and shall match the reference scan loss $P(\theta)=\cos^{1.29}(\theta)$ within 1 dB within a desired coverage area. In one exemplary embodiment, the maximum scan loss may be −6.5 dB at maximum scan. As used herein, the reference or objective scan loss characteristic is the idealized behavior from boresight to maximum scan.

In one exemplary embodiment, the arrangement of a portion of a fragmented aperture phased array antenna, such as the arrangement of the coupled antenna tiles, is designed using a multistage procedure that incorporates a genetic algorithm, or other suitable algorithm, for optimization and a finite-difference time-domain method for electromagnetic computation. For example, a stochastic hill climb optimization using a fine scale characterization based on optimization factors for a typical aperture may be implemented. The optimization factors may include one or more of: polarization, degree of orthogonality for dual polarizations, broadside scan degrees of freedom, H-plane scan degrees of freedom, E-plane scan degrees of freedom, phase, cost, footprint, number of antenna elements, parasitic aperture architecture including but not limited to the number of layers in the structure, amplitude, operational transmit frequency, operational receive frequency, instantaneous bandwidth, angular coverage, realized gain, boresight alignment, input impedance, scan loss, gain variable with frequency, gain variable with temperature, gain variation with polarization steering, grating lobes, maximum input power, group delay variation, and/or band response.

In one exemplary embodiment, a fragmented aperture phased array antenna is dynamically reconfigurable. In an exemplary embodiment, a control unit, using a vector generator controls the pointing angle of each radiating element. In another exemplary embodiment, the control unit controls the polarization of each radiating element. Polarization may include, linear (horizontal or vertical), circular (left-hand or right-hand), or elliptical of each radiating element. Moreover, the fragmented aperture may maintain a degree of orthogonality between two linear basis polarizations. Additionally, the control unit can adjust the polarization of any individual radiating element to compensate for polarization effects that may occur with scanning. For example, the control unit may correct for scan induced polarization degradation. Specifically, if one or both polarizations of the system have an amplitude and/or phase that changes with scan, then the individual portions of the fragmented array, such as the radiating elements, may be altered in relative amplitude and/or phase to restore the desired polarization quality of the radiated signal.

With renewed reference to the detailed assembly shown in FIG. 3, in an exemplary embodiment, a phased array antenna 300 comprises a radome 301, multiple aperture tiles 302, a cold plate 303, and multiple electrical components 304. Furthermore, in an exemplary embodiment, the multiple electrical components 304 comprise at least one electronics power converter, at least one broadband up-down converter, at least one time delay and control unit, and multiple tile power converters. In another exemplary embodiment, phased array antenna 300 further comprises a printed circuit board (PCB) support structure 305, and a phase compensation PCB 306. Phased array antenna 300 may also include a radome adapter plate 307 and/or a GPS antenna 308.

Figure 4B:
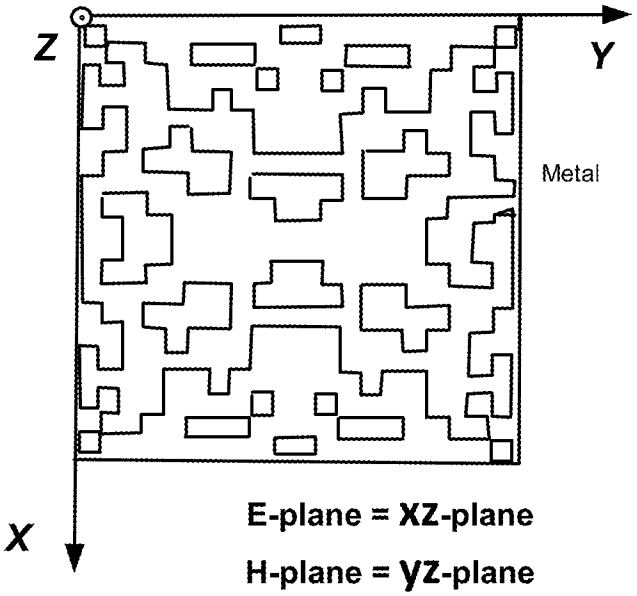
FIGS. 4A-4C illustrate an exemplary antenna tile unit, layout and degrees of freedom associated with an exemplary antenna tile unit.
Figure 4A:
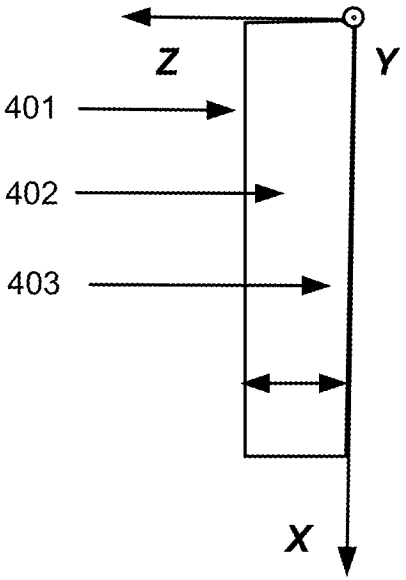
Figure 4C:
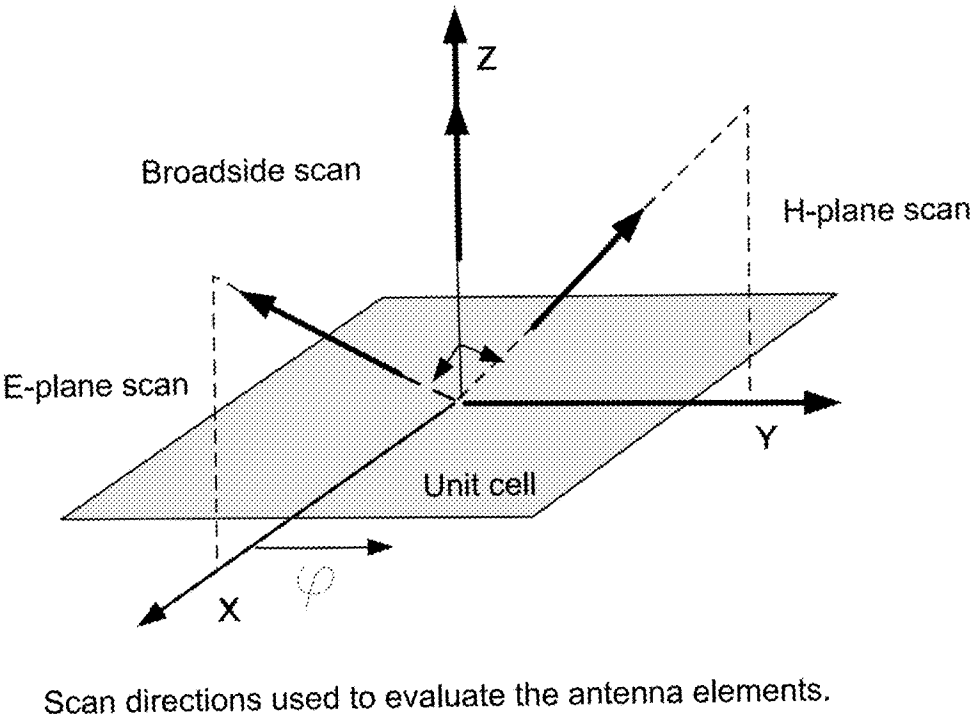

The multiple aperture tiles 302 comprises several aperture tiles in a plane arranged in various patterns, for example, a grid or offset, running bond pattern. In another exemplary embodiment, aperture tile 302 may further comprise a fragmented surface, dielectric substrate, and/or a ground plane. With reference to FIGS. 4A-4C, exemplary embodiments of a fragmented surface 401, a dielectric substrate 402, and a ground plane 403 are now discussed. The thickness and relative permittivity of dielectric substrate 402 and the distribution of the conducting regions in the aperture surface are predetermined based on desired antenna system performance.

In an exemplary embodiment, dielectric substrate 402 has a relative permittivity greater than 2.0. Furthermore, dielectric substrate 402 can be constructed of layers of like materials or can be constructed of layers of different materials. Various frequency ranges in specified scan directions may be achieved according to the metallic patterns and details of the fragmented aperture surface in both a driven layer and optional parasitic layers. The metallic patterns may include grounding posts or vias to control the energy that may otherwise flow transversely in the dielectric structure. An antenna system impedance may vary with scan direction as a result of coupling between closely spaced radiating elements. This condition is conventionally known as the active impedance of the array. The scan directions may comprise the H-plane, E-plane, and broadside scan for linear polarization.

Generally, aperture tile 302 may be configured to provide electronic scan in any direction away from the boresight axis and may be configured to scan within a conical section or an asymmetrical section of space above aperture tile 302. In an exemplary embodiment, aperture tile 302 is configured to scan 70° from boresight at 30 GHz. In another exemplary embodiment, aperture tile 302 is configured to scan 40° or more from boresight at frequency in the range of 20 GHz to 60 GHz, specifically about 52 GHz. In another embodiment, the frequency range is 10.7 GHz to 31 GHz. In addition, throughout the scan volume, aperture tile 302 may have electronic polarization control.

Figure 5A:
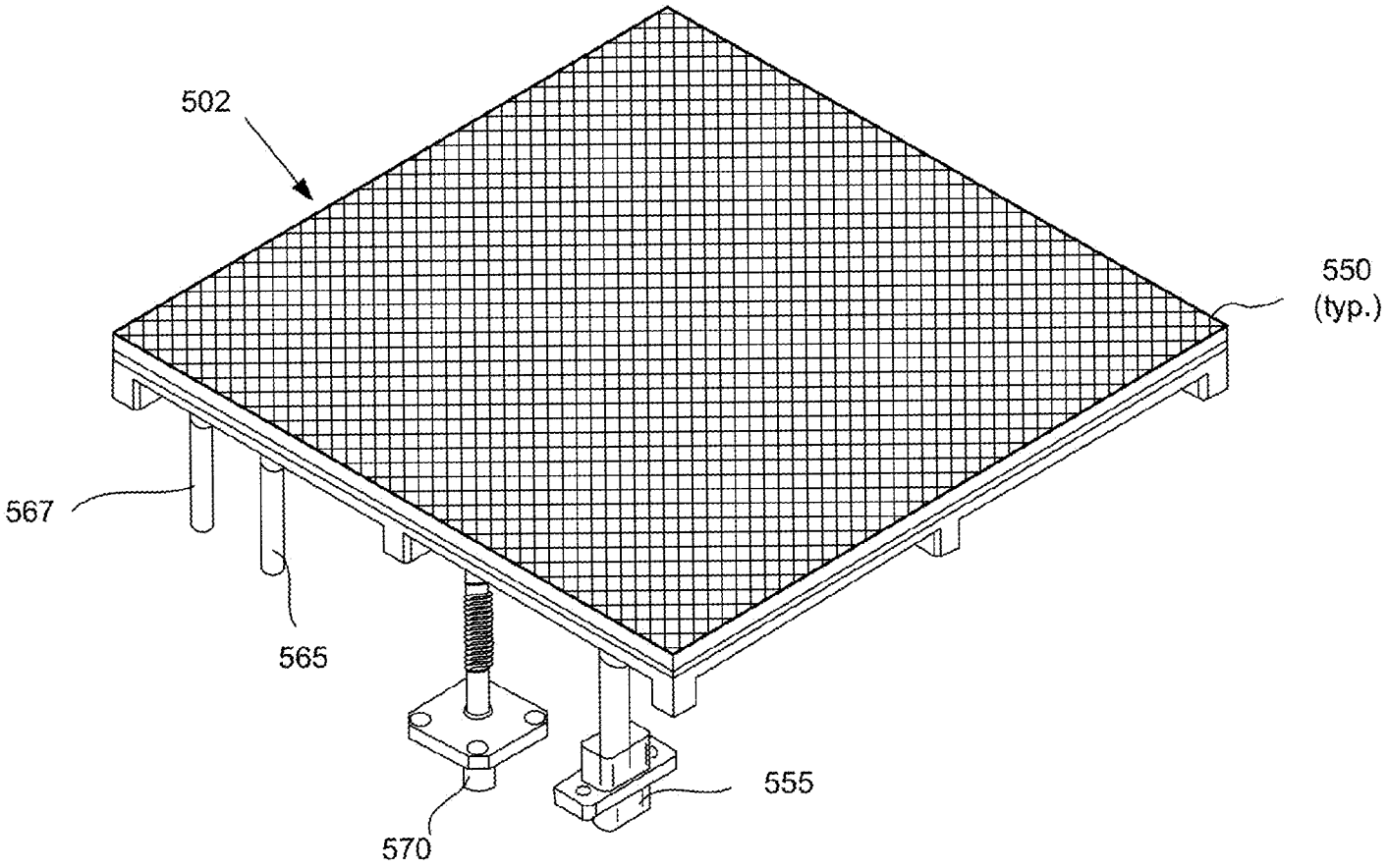
FIGS. 5A and 5B illustrate top and bottom views, respectively, of an exemplary antenna tile assembly according to various embodiments of the disclosure.
Figure 5B:
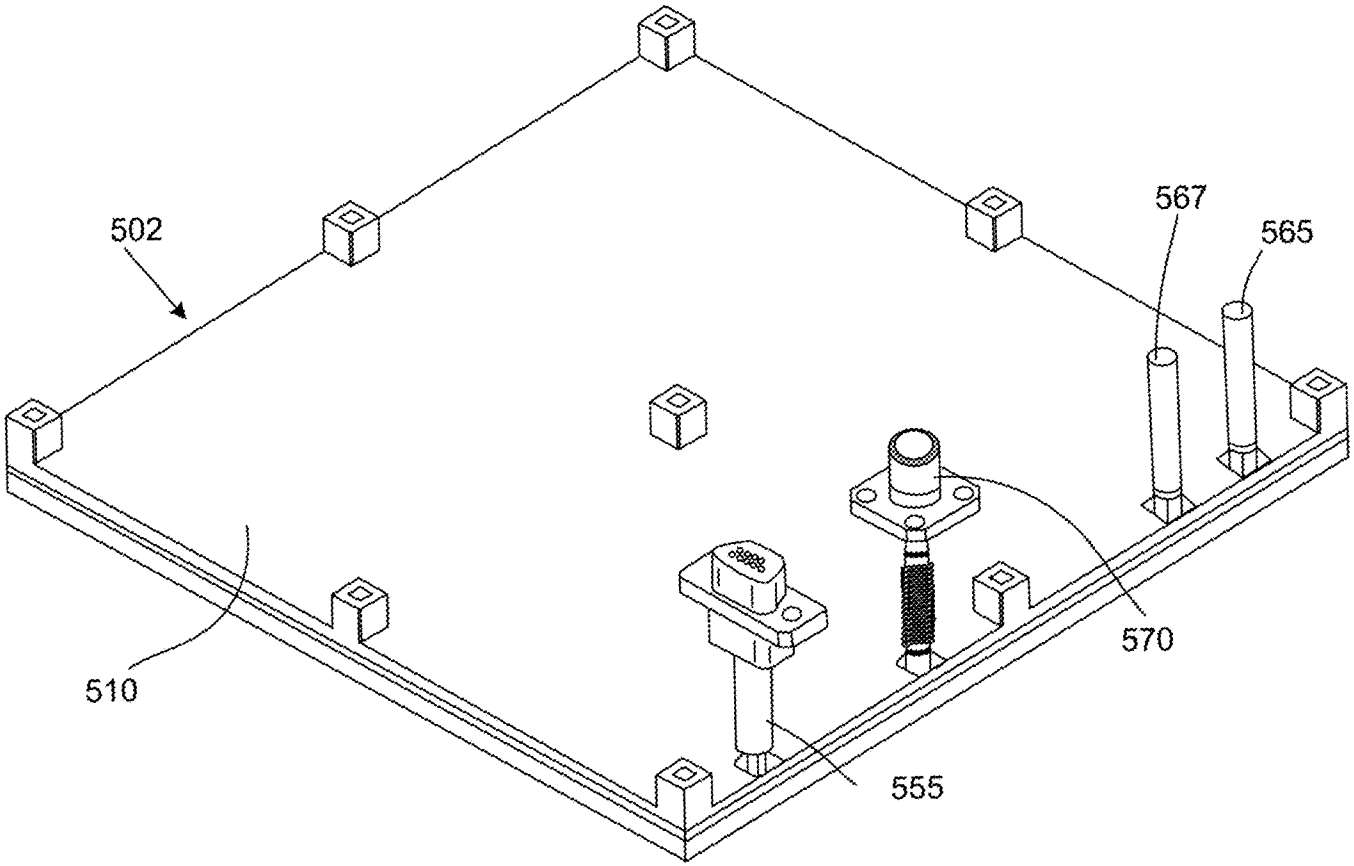

In one exemplary embodiment and with reference to FIGS. 5A and 5B, a single aperture tile 502 connects to electrical components 304 via a DC power input connector 565, a DC power output (or return) connector 567, a data/control signal connector 555, and a radio frequency (RF) connector 570. Aperture tile 502 further comprises multiple unit cells 550 in an array lattice.

In an exemplary embodiment, aperture tile 502 comprises an optimizable periodic unit cell 550. The periodic unit cell 550 can be a symmetrical portion of a radiating element such as a one-half portion or a one-quarter portion. Alternatively, in an exemplary embodiment, periodic unit cell 550 may comprise a full radiating element or multiple radiating elements. In various embodiments, periodic unit cell 550 may have a boundary that is square, rectangular, hexagonal, or other suitable shape. In an exemplary embodiment, periodic unit cells 550 are arranged on a square grid with the periodic unit cell size 550 being approximately one-half wavelength size of the highest frequency of operation. An exemplary aperture tile 502 comprises 576 periodic unit cells arranged in 24 rows and 24 columns. An exemplary aperture tile with an operational band from 10.7 to 31 GHz has a square grid size of 0.196 inch (5 cm). Moreover, the aperture tile can be other suitable sizes that could be determined, based on the information herein, by one skilled in the art.

In an exemplary embodiment, each periodic unit cell 550 of aperture tile 502 comprises four "feed vias." In another exemplary embodiment, each periodic unit cell 550 of aperture tile 502 comprises two "feed vias." The feed vias can be operated as differential pairs of feeds and each pair corresponds to a basis polarization of the radiating element. In one exemplary embodiment, a single pair of feed vias may be operated for a single basis polarization. Furthermore, in one exemplary embodiment, these feed vias are connected to balanced loads to terminate the signals entering the feed vias. In another exemplary embodiment, these feed vias are connected to at least one RF control module. In one exemplary embodiment, these feed vias are connected to the RF control modules through a beam stripline. In a second exemplary embodiment, these feed vias are connected to the RF control modules through a microstrip. In an exemplary embodiment, the microstrip is similar to the beam stripline in that both operatively contain RF transmission lines and may comprises RF power combiners and dividers.

In an exemplary embodiment, unit cell 550 comprises a single or dual polarized radiating element structure. In one exemplary embodiment, aperture tile 502 has a square lattice of radiating elements. In another exemplary embodiment, aperture tile 502 comprises a 24×24 lattice of dual polarized radiating elements, though any number of cell units may be arranged in any suitable configuration or shape. Furthermore, in another exemplary embodiment, the radiating elements operate over multiple frequency bands. For example, the radiating elements may be configured to operate over Ka-band and Ku-band frequencies. Similarly, in an exemplary embodiment, the radiating elements may operate over multiple polarizations. In one exemplary embodiment the phased array lattice of aperture tile 502 may be configured to communicate in half-duplex mode. In a second exemplary embodiment, aperture tile 502 may be for transmit only and in a third exemplary embodiment, aperture tile 502 may be for receive only. Moreover, antenna system configurations with separate aperture tiles for transmitting and for receiving may operate in full duplex mode.

Figure 6:
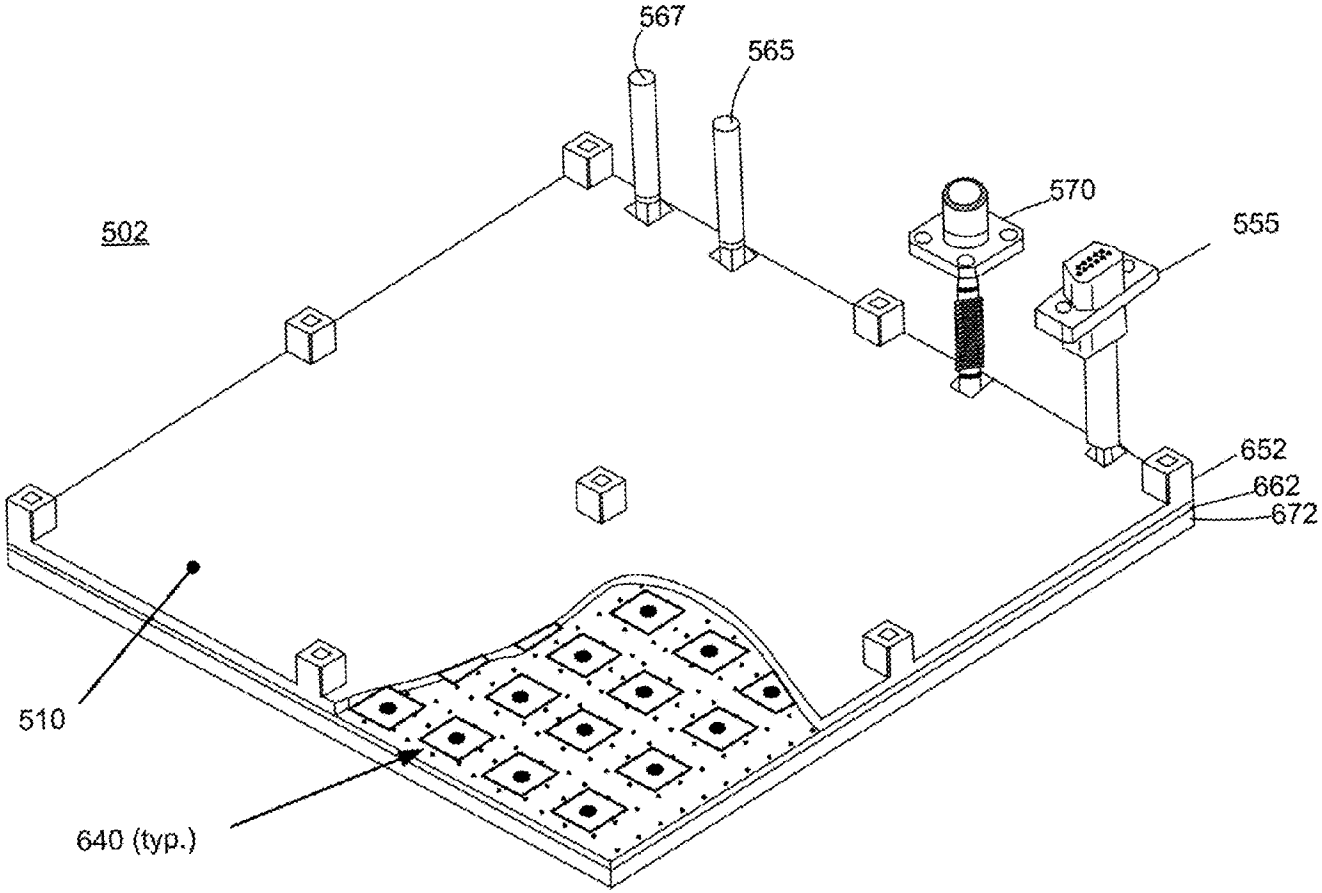
FIG. 6 illustrates a perspective view of an exemplary antenna tile assembly according to various embodiments of the disclosure.

In accordance with an exemplary embodiment and with reference to FIG. 6, aperture tile 502 comprises multiple layers, including an antenna laminate layer 672, a control/power laminate layer 662, and an RF circuit laminate layer 652. In an exemplary embodiment, aperture tile 502 further comprises a heat transfer layer 510, such as a cold plate. FIG. 6 also illustrates a cut-away view of an exemplary RF circuit laminate layer 652, which comprises an arrangement of RF control modules 640.

Figure 7A:
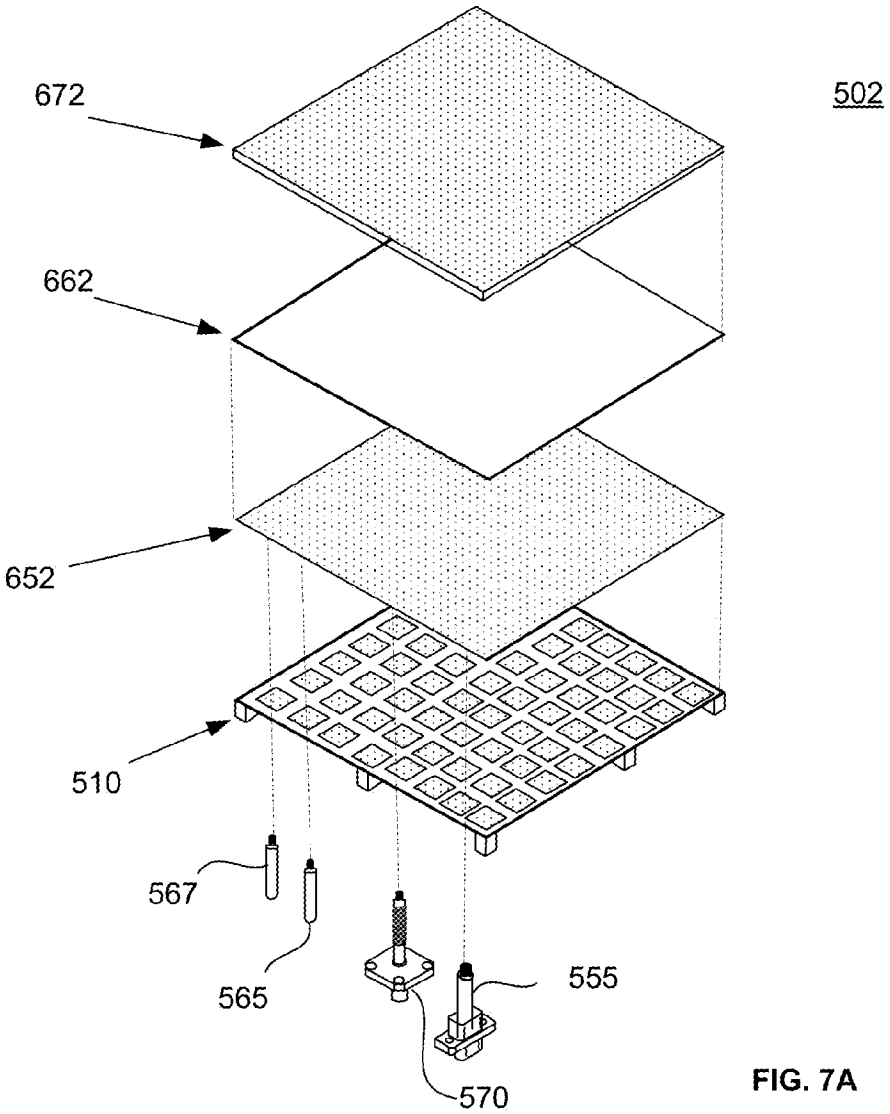
FIGS. 7A and 7B illustrate exploded views of an exemplary antenna tile assembly according to various embodiments of the disclosure.
Figure 7B:
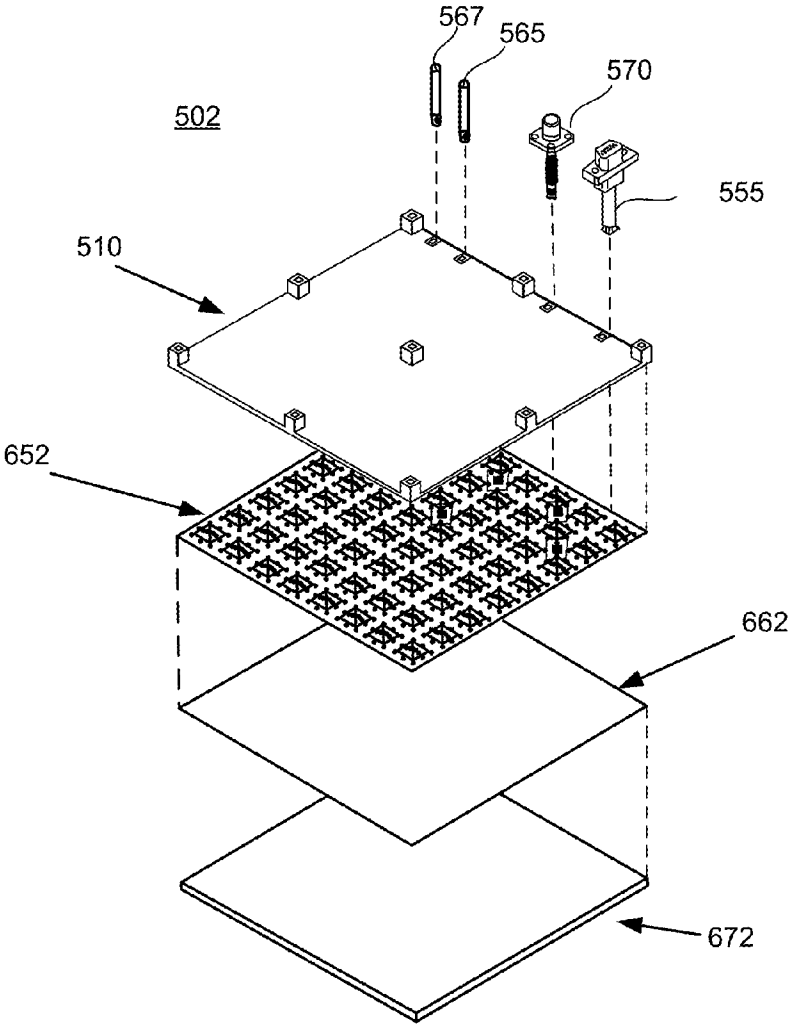

In an exemplary embodiment, and with reference to FIGS. 7A and 7B, an exploded view of aperture tile 502 is illustrated. As previously described, aperture tile 502 comprises an antenna laminate layer 672, a control/power laminate layer 662, an RF circuit laminate layer 652, and a heat transfer layer 510. Furthermore, FIGS. 7A and 7B illustrates the connection between RF circuit laminate layer 652 and various connectors, such as DC power input connector 565, DC power output connector 567, data/control signal connector 555, and radio frequency (RF) connector 570.

Figure 8A:
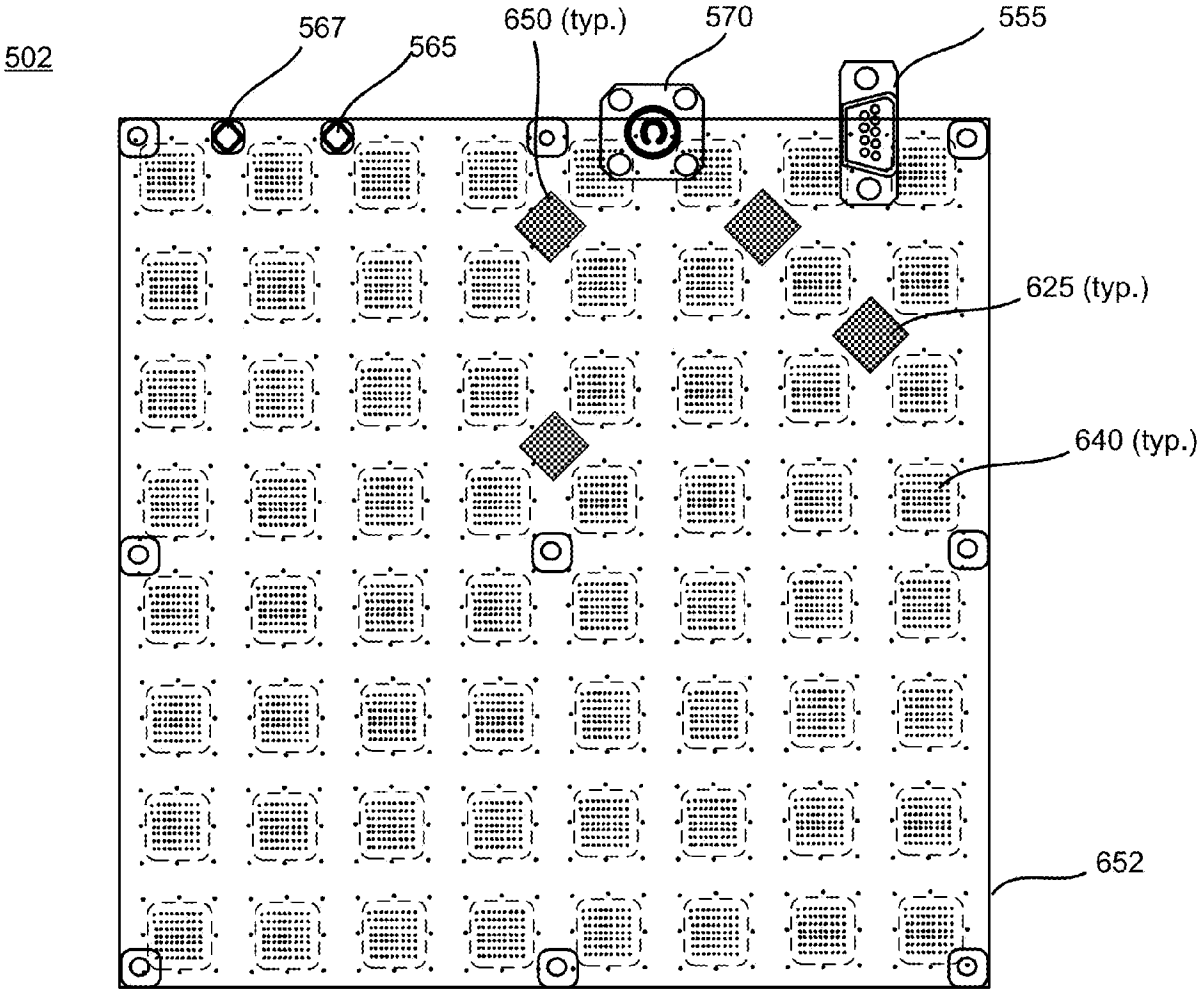
FIGS. 8A and 8B illustrate an aft view and a side view respectively, of an exemplary antenna tile assembly according to various embodiments of the disclosure.
Figure 8B:
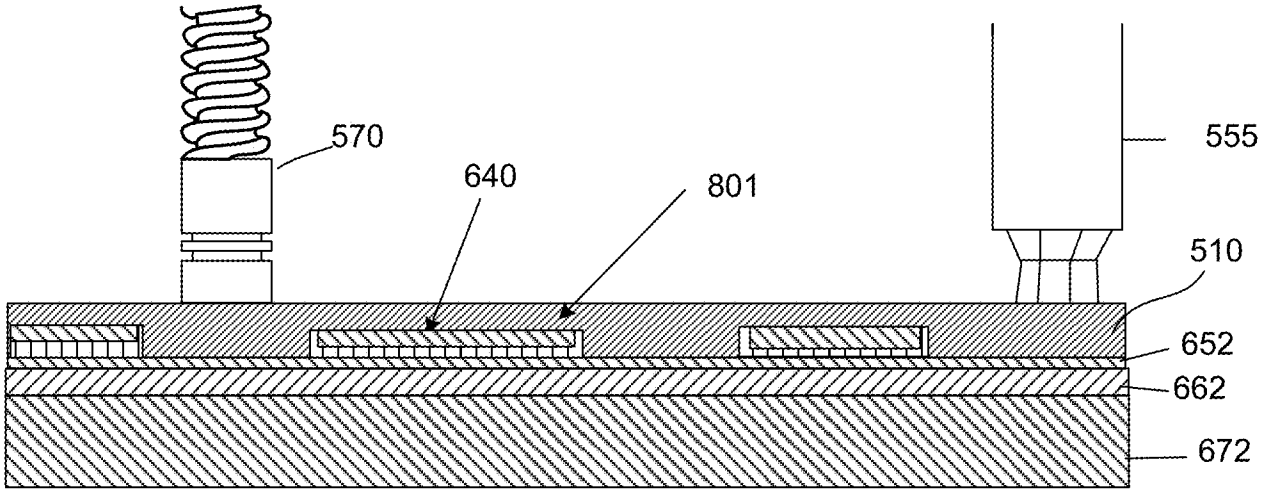

Furthermore, in accordance with an exemplary embodiment and with reference to FIGS. 8A and 8B, aperture tile 502, and specifically RF circuit laminate layer 652, comprises various active modules. In an exemplary embodiment, the active modules include RF control modules 640. In another exemplary embodiment, RF circuit laminate layer 652 comprises at least one time delay module 625, and/or at least one digital signal processor (DSP) 650. With reference to FIG. 8B, in an exemplary embodiment, heat transfer layer 510, such as a cold plate, is coupled to RF circuit laminate layer 652. In an exemplary embodiment, cold plate 510 may comprise openings to create a recess cavity 801. Recess cavity 801 is configured to receive to a portion of phased array antenna 300, such as the active modules (for example, RF control modules 640). In one exemplary embodiment, these openings may be sized to mirror the size of the active modules without touching the active modules.

Figure 9:
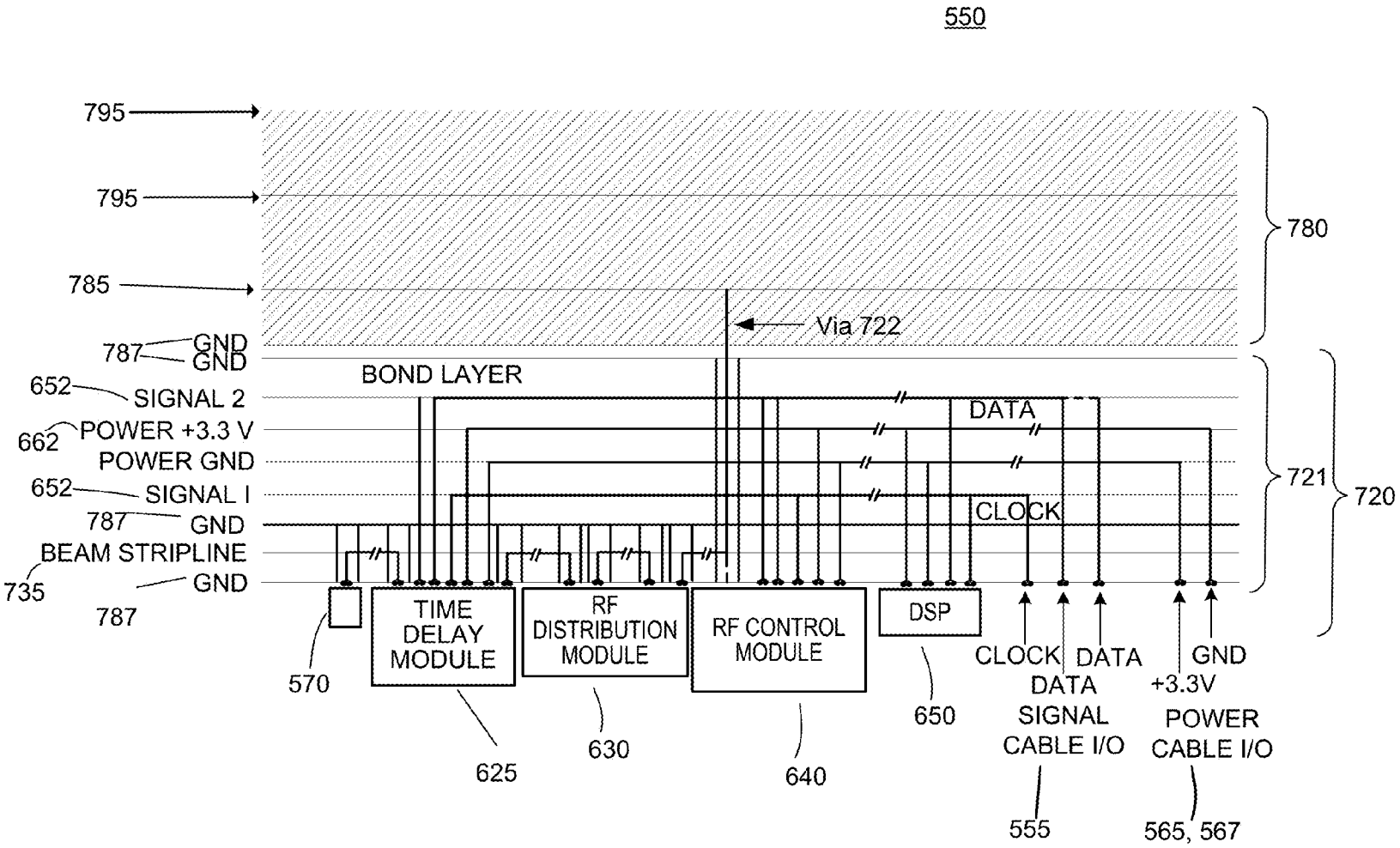
FIG. 9 illustrates an exemplary antenna tile printed circuit board layout according to various embodiments of the disclosure.

In one exemplary embodiment and with reference to FIG. 9, a unit cell 550 is a portion of aperture tile 502. In one exemplary embodiment, unit cell 550 comprises a driven radiating element layer 780 and a module layer 720, where module layer 720 includes a printed circuit board (PCB) layer 721. In an exemplary embodiment, module layer 720 provides amplification and signal distribution. Furthermore, in another exemplary embodiment, module layer 720 provides at least one of element control and RF signal vector control.

In an exemplary embodiment and with continued reference to FIG. 9, module layer 720 comprises a beam stripline 735, data/control signal connector 555, DC power input connector 565, DC power output connector 567, and radio frequency (RF) connector 570. In another exemplary embodiment, module layer 720 further comprises an RF distribution module 630, and RF control module 640. In yet another exemplary embodiment, module layer 720 further comprises digital signal processor (DSP) 650, and/or time delay module 625. DSP 650 and time delay module are implemented for larger scale antenna systems for added signal processing and control. In an exemplary embodiment, RF connector 570 comprises a coaxial connector. In accordance with an exemplary embodiment, module layer 720 and beam stripline 735 along with data/control signal connector 555, DC power input connector 565, DC power output connector 567, and RF connector 570 are housed in aperture tile 502. In the prior art, many of these elements were previously located off chip and coupled to the radiating element though a wired coupling. However, the wired couplings of the prior art may introduce one or more of losses, extra hardware, and costs.

As previously described, driven radiating element layer 780 is coupled to module layer 720, generally in a layered manner. In an exemplary embodiment, driven radiating element layer 780 comprises driven element 785 and a ground plane 787 to form a radiating element. In another exemplary embodiment, driven radiating element layer 780 further comprises a dielectric material, such as an aperture parasitic 795. In an exemplary embodiment, driven element 785 is operatively connected to RF control module 640, and RF control module 640 contains one or more electronic devices.

In accordance with an exemplary embodiment, and with continued reference to FIG. 9, all of the layers between driven element 785 layer and the MMIC module layer in PCB layer 721 have a dielectric with relative permittivity greater than 2.0. In other words, the construction of the layers between driven element 785 and PCB layer 721, including throughout PCB layer 721, are comprised of materials with a relative permittivity greater than 2.0. In other words, in the exemplary embodiment, there are no foam type materials with relative permittivity values less than 2.0 within the boundaries defined by driven element 785 and PCB layer 721, including throughout PCB layer 721. Accordingly, in this exemplary embodiment, a via 722 connecting RF control module 640 and driven layer 785 traverses materials having a relative permittivity greater than 2.0 and does not pass through any foam type materials with relative permittivity values less than 2.0. In contrast, in an exemplary embodiment, dielectric materials of layers between driven element 785 and aperture parasitic 795 may contain materials with relative permittivity values less than 2.0 or greater than 2.0.

In one exemplary embodiment, module layer 720 is fabricated out Rogers Corporation RO4003 high frequency circuit material. In a second exemplary embodiment, module layer 720 is fabricated from a PTFE laminate such as Arlon DiClad-880 or Rogers Corporation 5880. In another exemplary embodiment, module layer 720 may be fabricated out of a material with a stable dielectric constant greater than 2.0 over a broad frequency range, such as the ceramic loaded PTFE based Rogers Corporation RO3003 or Arlon CLTE-XT. In another exemplary embodiment, FR4 may be utilized for various layers of module layer 720, such as RF circuit laminate layer 652 or control/power laminate layer 662. Furthermore, in other exemplary embodiments, module layer 720 is fabricated out of any suitable printed circuit board material, such as a glass reinforced hydrocarbon/ceramic thermoset laminate. In other exemplary embodiments, module layer 720 is fabricated out of a material with a low temperature coefficient of dielectric constant.

In one exemplary embodiment, module layer 720 comprises a beam stripline 735. The beam stripline 735 may be a transverse electromagnetic (TEM) transmission line medium. The width of the strip, the thickness of the substrate and the relative permittivity of the substrate determine the characteristic impedance of the strip, which is a transmission line. One or more of time delay module 625, RF distribution module 630, and RF control module 640 may be coupled to beam stripline 735. Furthermore, in an exemplary embodiment, beam stripline 735 is configured to perform one or more of routing, passive power dividing, and passive power combining the RF signals coupled to RF connector 570. A portion of the power dividing and/or power combining may be contained in RF control module 640 or a separate RF module.

In one exemplary embodiment, time delay module 625 is configured to provide a true time delay of the RF signal coupled to RF connector 570. Time delay may be utilized in addition to vector control in applications, resulting in wide bandwidths and wide scan angles for some aperture sizes. Furthermore, in an exemplary embodiment, time delay module 625 may be on the tile or associated with the electronics on the opposing side of the cold plate. For instance, time delay module 625 may conventionally comprise a switch delay line and/or plurality of RF transmission line segments with varied lengths. In accordance with an exemplary embodiment, time delay module 625 comprises a monolithic microwave integrated circuit (MMIC) to facilitate operation and result in a compact size. The MMIC may be made of silicon germanium, gallium arsenide, or other suitable material. In an exemplary embodiment, the total time delay injected by time delay module 625 is a function of the specific switch delay lines selected for utilization. The selection of the specific switch delay lines, in an exemplary embodiment, is based in part on an antenna aperture size and instantaneous bandwidth. In an exemplary embodiment, time delay module 625 has nine bits of control. In one exemplary embodiment, time delay module 625 is utilized on aperture tile 502 prior to an antenna system summing signals from two or more aperture tiles, using a next level RF power combining network. In another exemplary embodiment, time delay module 625 is utilized within a next level RF power combining network. Moreover, in an exemplary embodiment, time delay module 625 is electrically coupled to one or more RF control modules 640, RF distribution modules 630, DSP 650, data/control signal connector 555, DC power input connector 565, and/or DC power output connector 567.

Similarly, in an exemplary embodiment, RF distribution module 630 comprises a MMIC implemented power divider (or power combiner). The MMIC may be made of silicon germanium, gallium arsenide, or other suitable material. The power divider may be a passive power divider or may be an active power divider. Active power dividers may have zero net gain or may provide a positive RF signal gain. Furthermore, active power dividers may be more compact than passive power dividers but do consume electrical power. In an exemplary embodiment, RF distribution module 630 is electrically coupled to one or more time delay modules 625, and/or RF control modules 640. In an exemplary embodiment, beamforming for all of the radiating elements is accomplished on aperture tile 502 by at least the combination of RF control modules 640, RF distribution modules 630 and beam stripline 735. In accordance with an exemplary embodiment, RF distribution module 630 comprises a MMIC to facilitate operation and result in a compact size. Exemplary RF control modules 640 contain a plurality of vector generators that provide the phase and amplitude control at each radiating element and perform the polarization control. Furthermore, RF control modules 640 may perform beamforming for a subset of radiating elements. In one exemplary embodiment, RF control module 640 carries out the beamforming for eight radiating elements. In another embodiment, RF control module 640 carries out the beamforming for four radiating elements. Moreover, in an exemplary embodiment, RF control module 640 is configured to carry out the beamforming for any number of radiating elements, as would be understood by one skilled in the art. The remaining beamforming within aperture tile 502 may be shared by RF distribution module 630 and beam stripline 735. One optional approach is to carry out the remaining beamforming with RF distribution module 630 and rely on beam stripline 735 for RF signal routing. It is advantageous to carry out at least a portion of the remaining beamforming within RF distribution module 630 in order to reduce the size and complexity of beam stripline 735. However, in an exemplary embodiment, all remaining beamforming on aperture tile 502 can be completed within beam stripline 735.

Similar to time delay module 625 and RF distribution module 630, in an exemplary embodiment, RF control module 640 comprises a MMIC to facilitate operation and result in a compact size. The MMIC may be made of silicon germanium, gallium arsenide, or other suitable material. In accordance with an exemplary embodiment, RF control module 640 includes a vector control device. In one exemplary embodiment, the vector control device may control phase and amplitude of each element. In another exemplary embodiment, the vector control device may not comprise a separate phase shifter and attenuator but instead may comprise a single entity, such as a vector generator. The vector generator can be configured to control the phase and amplitude of signals.

In an exemplary embodiment, DSP 650 may provide local beam steering calculations and commands for each element. These steering calculations and commands may include I vector and Q vector calculations and commands. The steering calculations and commands may include both amplitude and phase calculations and commands for the vector control device. In an exemplary embodiment, DSP 650 provides a calculation and/or command to a vector generator for each basis polarization, phase and/or amplitude, for each element. The aggregate of the elements' polarization results in the total polarization of phased array antenna 300. In another exemplary embodiment, steering corrections may also be performed by a vector generator located off chip. These off chip corrections and commands may be communicated to the chip through a serial cable. The DSP 650 may be electrically coupled to one or more time delay modules 625, RF control modules 640, data/control signal connector 555, DC power input connector 565, and/or DC power output connector 567.

In accordance with an exemplary embodiment, RF control module 640 communicates bidirectional signals with the radiating element and includes a low noise amplifier (LNA) for receive signals and an RF power amplifier (PA) for transmit signals (not shown). In an exemplary embodiment, there is an LNA and a PA corresponding to each basis polarization of a radiating element. In an exemplary embodiment, RF control module 640 comprises the vector generators for each basis polarization. Vector generators may be separate for transmit and receive or they may be shared by transmit and receive operations. RF control module 640 may be electrically coupled to one or more of time delay module 625, RF distribution module 630, driven element 785, DSP 650, data/control signal connector 555, DC power input connector 565, and/or DC power output connector 567. Furthermore, RF control module 640 may send a signal to driven element 785. In accordance with an exemplary embodiment, RF control module 640 may include a vector control device. Phase and amplitude may be controlled for each basis polarization of each radiating element. Basis polarizations may be linear polarizations in the fragmented aperture design. Though they may be any orientation, in one exemplary embodiment the radiating elements comprise a square grid arrangement. In an exemplary embodiment, the linear polarizations are defined to be in the principal planes of the square grid for the boresight beam position. In an alternate exemplary embodiment, the linear polarizations are defined to be in the diagonal planes of the square grid for the boresight beam position.

In one exemplary embodiment, the radiating element of unit cell 550 may comprise any radiating element suitable to function as an antenna. For instance, the radiating element may be integrated on a printed circuit board (PCB) to form a PCB integrated radiating element. In another exemplary embodiment, the radiating element may comprise a dielectric plug radiator. A PCB integrated radiating element may be fabricated out of any suitable printed circuit board material. One example of a suitable material is Rogers corporation RO4003 high frequency circuit material. In another exemplary embodiment, the printed circuit board integrated radiating element may be fabricated out of a glass reinforced hydrocarbon/ceramic thermoset laminate. In one exemplary embodiment, the printed circuit board integrated radiating element may be fabricated out of a material with a low temperature coefficient of dielectric constant. In another exemplary embodiment, the printed circuit board integrated radiating element may be fabricated out of a material with a stable dielectric constant over a broad frequency range.

In one exemplary embodiment, unit cell 550 uses a fragmented aperture antenna and the radiating element is implemented in at least three conducting layers of a printed circuit board. The first conducting layer acts as a ground plane to the radiating element and the second conducting layer is the driven element and is direct connected to RF control module 640. A third conducting layer corresponds to a parasitic layer above the driven layer. In addition, there may be more than one parasitic layer in the radiating element design depending on the requirements for specific bands and scan performance.

The module layer 720 and driven radiating element layer 780 may be coupled together. In an exemplary embodiment, this coupling is made by any suitable means, such as by bond film, pre-preg and/or etching and bonding laminations. In one exemplary embodiment, module layer 720 and driven radiating element layer 780 constitute a single monolithic element. Additionally, in another exemplary embodiment, aperture tile 502 may be coupled to a control/telemetry unit or tile interface unit. Aperture tile 502 may also be coupled to a radome, such as an A-sandwich radome. Aperture tile 502 may be used with a B-sandwich or C-sandwich type radome or a radome comprising a plurality of layers. Furthermore, the radome may contain metal layers with circuit properties to provide frequency selective transmission properties. Moreover, in an exemplary embodiment, aperture tile 502 may further be coupled to a thermal management unit, such as a heat sink and/or a cold plate.

Various devices and methods have been used for cooling an array antenna system; such devices include use of a fan blower, which blows ambient air across the electrical components. Another typical device for dissipating heat from the antenna is a coil system that pumps cooled liquid throughout the antenna. The cooled liquid absorbs the heat from the antenna and is pumped to another coil section that is configured to transfer heat away from the system. Liquid systems use pumping in order to maintain the temperature control.

Figure 10:
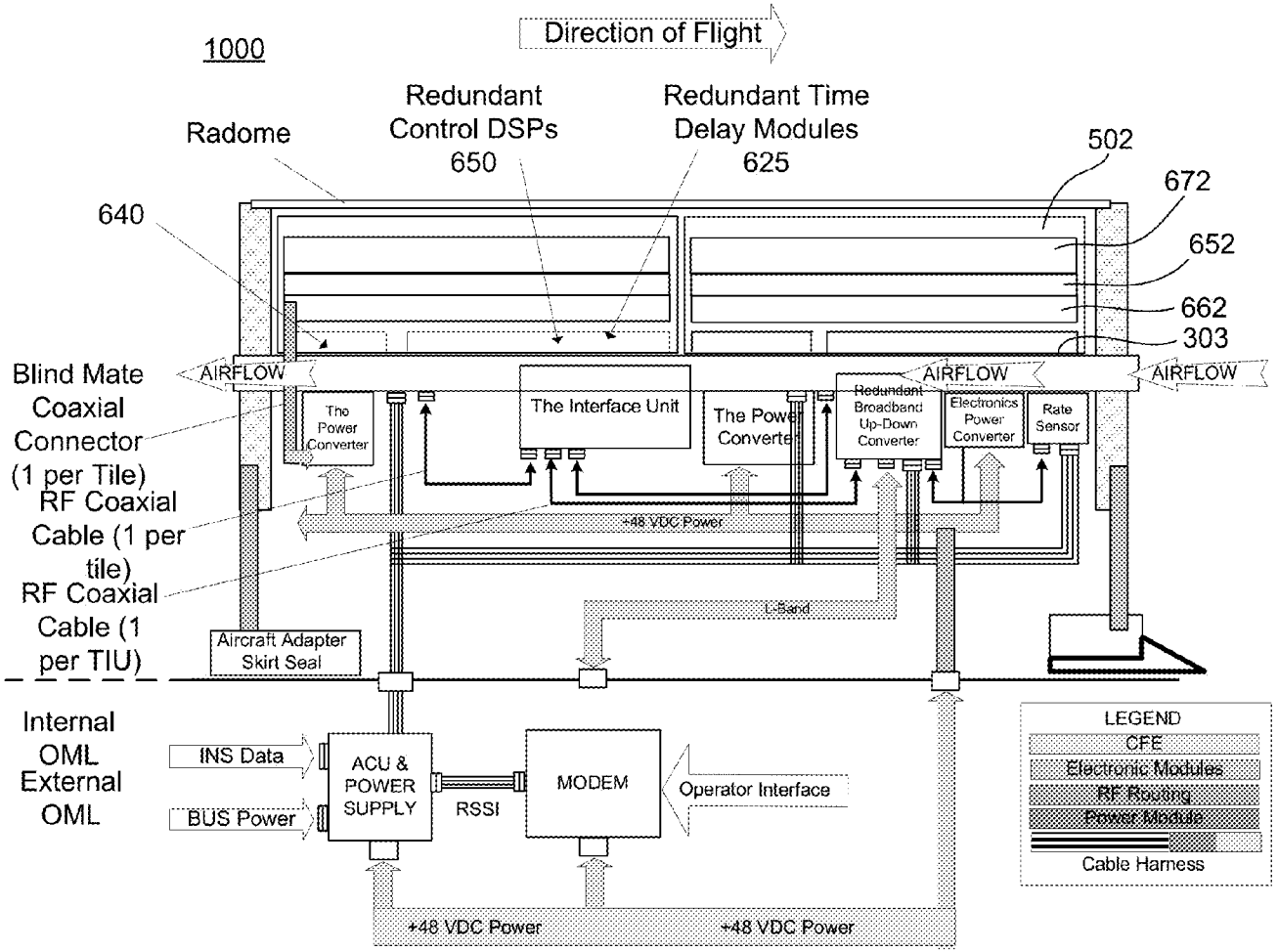
FIG. 10 illustrates a functional block diagram of an exemplary antenna tile according to various embodiments of the disclosure.

In addition to the electrical components and modules of an antenna tile, an antenna system also operatively uses other active components. In one exemplary embodiment and with reference to FIG. 10, an antenna system 1000 may be coupled to one or more modems. Furthermore, in an exemplary embodiment, antenna system 1000 includes a broadband up-down converter. The exemplary antenna system has a L-band intermediate frequency (IF) interface with the modem that can be 900 to 1500 MHz for Ka-band RF operation or 950 to 2150 MHz for Ku-band operation. An alternate exemplary antenna system can be 950 to 2050 MHz for Ka-band operation. Moreover, the antenna system may have an IF interface frequency as designed, and thus not limited to the above frequency ranges. In addition, RF signals may be stacked in different IF bands. For example, a first band of frequencies may be in the 300 to 800 MHz band and a second band of frequencies may be in the 1650 to 2150 MHz band in a stacked arrangement. The use of an L-band IF interface allows for the modem and antenna system to have a significantly greater installed separation distance between the units in contrast to units that are configured with a Ku-band or Ka-band interface. Furthermore, the use of an IF interface allows greater interoperability with modems across a deployed network and leads to lower overall system costs.

Each aperture tile 502 unit may be coupled to an adjacent aperture tile 502 by coaxial cables, flexible stripline, or other suitable transmission line means. In one exemplary embodiment, one or more aperture tiles 502 coupled together comprise a fragmented aperture. In an exemplary embodiment, a control unit controls operation of each radiating element. The radiating element operation is controlled, in one exemplary embodiment, by the control unit. In an exemplary embodiment, the control unit comprises a centrally located CPU with connections to each aperture tile via a serial bus. In another exemplary embodiment, the control unit is a combination of a centrally located processor and distributed processors or DSP in proximity with a group of aperture tiles 502. Alternatively, the distributed processors may be on each individual tile in the antenna system. Moreover, in an exemplary embodiment, the control unit configures the polarization of each aperture tile 502. The polarizations may be configured for linear polarization (horizontal or vertical) or circular polarization (left-hand or right-hand) of each aperture tile 502. The polarization may also be configured for elliptical polarization. In an exemplary embodiment, the polarization is configured for linear polarization or circular polarization with a high degree of linear or corresponding circular polarization purity. In other words, the polarization is configured for a linear or circular polarization characteristic with a defined maximum cross-polarization. In another exemplary embodiment, the control unit controls the pointing angle of each aperture tile 502. The pointing angle is the beam steering angle relative to the boresight direction of aperture tile 502.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the draft statements. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The invention claimed is:

1. An antenna system comprising:

an array of antenna elements, wherein each antenna element of the array comprises:

a radiating element;

a plurality of feeds coupled to the radiating element, the plurality of feeds including a first feed corresponding to a first basis polarization and a second feed corresponding to a second basis polarization;

a plurality of subcircuits responsive to commands to adjust first and second RF signals communicated with the first and the second feeds respectively of each of the antenna elements of the array; and a digital control to provide the commands to the subcircuits, wherein the provided commands are used by the subcircuits to scan a beam of the adjusted RF signals to a particular scan angle by adjusting the first and the second RF signals of each antenna element relative to the first and the second RF signals of other antenna elements of the array, and to compensate for cross-polarization in the beam due to the particular scan angle by adjusting the first RF signal relative to the second RF signal of each antenna element.

2. The antenna system of claim 1, wherein the provided commands are used by the subcircuits to adjust individual polarization components of the beam.

3. The antenna system of claim 2, wherein the individual polarization components of the beam are orthogonal to one another.

4. The antenna system of claim 2, wherein the individual polarization components correspond to the first and second basis polarizations.

5. The antenna system of claim 1, wherein the provided commands are used by the control circuits to compensate for the cross-polarization by at least correcting for polarization rotation of the beam at the particular scan angle.

6. The antenna system of claim 1, wherein the subcircuits adjust relative amplitudes and relative phases of the RF signals.

7. The antenna system of claim 6, wherein the subcircuits include vector generators to adjust the relative amplitudes and the relative phases.

8. The antenna system of claim 1, wherein the provided commands are used by the subcircuits to simultaneously scan multiple beams of the adjusted RF signals to corresponding scan angles, and compensate for cross-polarization in each of the multiple beams due to the corresponding scan angles.

9. The antenna system of claim 1, wherein a subcircuit of the plurality of subcircuits is shared among multiple antenna elements of the array.

10. The antenna system of claim 1, wherein the provided commands are used by the subcircuits to control polarization of the beam.

11. The antenna system of claim 1, further comprising a printed circuit board including a first side and a second side, wherein the radiating elements are on the first side, and the subcircuits are on the second side.

12. The antenna system of claim 11, further comprising a heat transfer layer coupled to the second side of the circuit board.

* * * * *